US008777655B2

(12) United States Patent
Blanton

(10) Patent No.: US 8,777,655 B2
(45) Date of Patent: Jul. 15, 2014

(54) WIRE POWER CORD RETAINER

(71) Applicant: Panduit Corp., Tinley Park, IL (US)

(72) Inventor: Derek W. Blanton, Canton, GA (US)

(73) Assignee: Panduit Corp., Tinley Park, IL (US)

( * ) Notice: Subject to any disclaimer, the term of this patent is extended or adjusted under 35 U.S.C. 154(b) by 61 days.

(21) Appl. No.: 13/649,685

(22) Filed: Oct. 11, 2012

(65) Prior Publication Data

US 2013/0095691 A1 Apr. 18, 2013

Related U.S. Application Data

(60) Provisional application No. 61/547,161, filed on Oct. 14, 2011.

(51) Int. Cl.
*H01R 13/62* (2006.01)
*H01R 13/639* (2006.01)

(52) U.S. Cl.
CPC ..... *H01R 13/6395* (2013.01); *H01R 13/6392* (2013.01)
USPC ..... 439/372

(58) Field of Classification Search
USPC ..... 439/372, 373
See application file for complete search history.

(56) References Cited

U.S. PATENT DOCUMENTS

| | | | | |
|---|---|---|---|---|
| 5,593,313 | A | 1/1997 | Shibuya et al. | |
| 5,860,827 | A | 1/1999 | Lee | |
| 6,101,091 | A | 8/2000 | Baik | |
| 6,767,237 | B1 | 7/2004 | Shih | |
| 6,851,964 | B2 * | 2/2005 | Miller | 439/372 |
| 7,101,215 | B2 | 9/2006 | Woellner et al. | |
| 7,203,066 | B2 | 4/2007 | Lee et al. | |
| 7,232,330 | B2 | 6/2007 | Woellner et al. | |
| 7,233,496 | B2 | 6/2007 | Lee et al. | |
| 7,515,419 | B2 | 4/2009 | Li et al. | |
| 7,518,874 | B2 | 4/2009 | Deng et al. | |
| 7,524,205 | B1 | 4/2009 | Lee | |
| 7,722,380 | B1 | 5/2010 | West et al. | |
| 7,746,647 | B2 | 6/2010 | Guo et al. | |
| 7,850,478 | B2 | 12/2010 | Lin et al. | |
| 7,857,654 | B2 | 12/2010 | West et al. | |
| 7,938,671 | B2 | 5/2011 | Hayden, Sr. | |
| 2003/0209361 | A1 | 11/2003 | Sivertsen | |
| 2005/0054235 | A1 * | 3/2005 | Miller | 439/372 |
| 2005/0170680 | A1 * | 8/2005 | Miller | 439/372 |
| 2008/0076291 | A1 | 3/2008 | Ewing et al. | |
| 2010/0105232 | A1 | 4/2010 | Lin et al. | |

* cited by examiner

*Primary Examiner* — Gary Paumen

(74) *Attorney, Agent, or Firm* — Christopher S. Clancy; James H. Williams

(57) ABSTRACT

An apparatus for retaining a plug in an outlet is provided. The apparatus includes a body and a pair of arms extending from opposite sides of the body. The body includes a retaining tab for retaining the plug in the outlet and a pair of locking tabs extending from opposite sides of the retaining tab for locking the retaining tab to the plug. Additionally, or in the alternative, each of the arms includes a safety loop for preventing the arms from being electrically connected to the outlet.

20 Claims, 12 Drawing Sheets

WIRE POWER CORD RETAINER

CROSS REFERENCE TO RELATED APPLICATIONS

This application claims priority to U.S. Provisional Patent Application No. 61/547,161, filed on Oct. 14, 2011, which is incorporated by reference in its entirety.

BACKGROUND OF THE INVENTION

The present invention relates to a wire power cord retainer. More particularly, the present invention relates to a wire power cord retainer for a power outlet unit ("POU").

Wire power cord retainers are well known in the art. For example, U.S. Pat. Nos. 6,767,237 and 7,850,478 disclose wire power cord retainers. However, existing wire power cord retainers clip to the power cord, allowing the power cord to rotate. Additionally, existing wire power cord retainers are difficult to install, typically requiring at least partial disassembly of the POU prior to installation, and because the POU provides power, there is also a risk of electric shock during installation.

Therefore, there is a need for a wire power cord retainer that is secured to the power cord. Additionally, there is a need for a wire power cord retainer that is easy to install and eliminates any risk of electric shock during installation.

SUMMARY OF THE INVENTION

An apparatus for retaining a plug in an outlet is provided. The apparatus includes a body and a pair of arms extending from opposite sides of the body. The body includes a retaining tab for retaining the plug in the outlet and a pair of locking tabs extending from opposite sides of the retaining tab for locking the retaining tab to the plug. Additionally, or in the alternative, each of the arms includes a safety loop for preventing the arms from being electrically connected to the outlet.

DETAILED DESCRIPTION

FIGS. 1-12 illustrate a wire power cord retainer 100 for retaining a power cord 200 in a power outlet unit ("POU") 300, such as Panduit's Basic, Metered, or Networked POU, according to several embodiments of the present invention.

Figure 1:
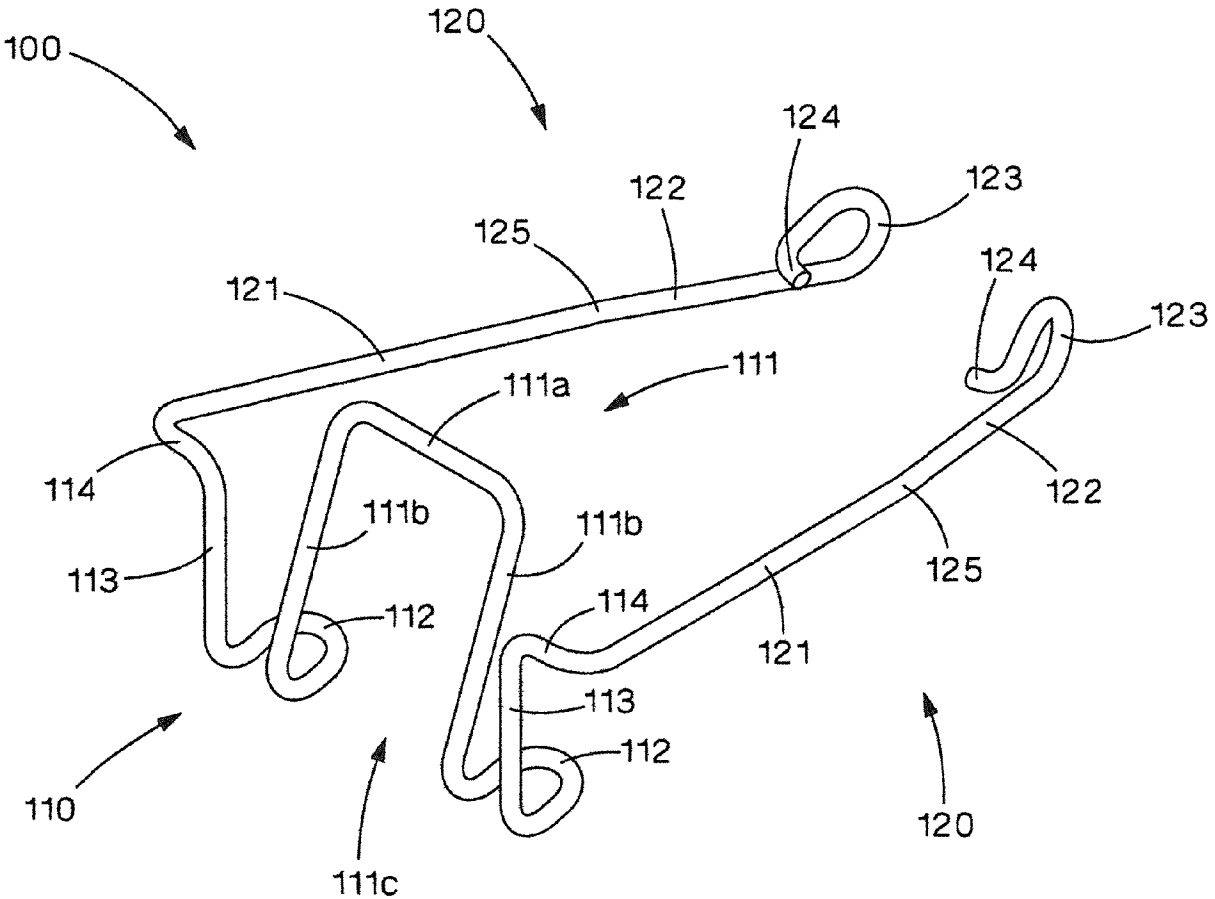
FIG. 1 is a perspective view of a wire power cord retainer according to an embodiment of the present invention.
Figure 2:
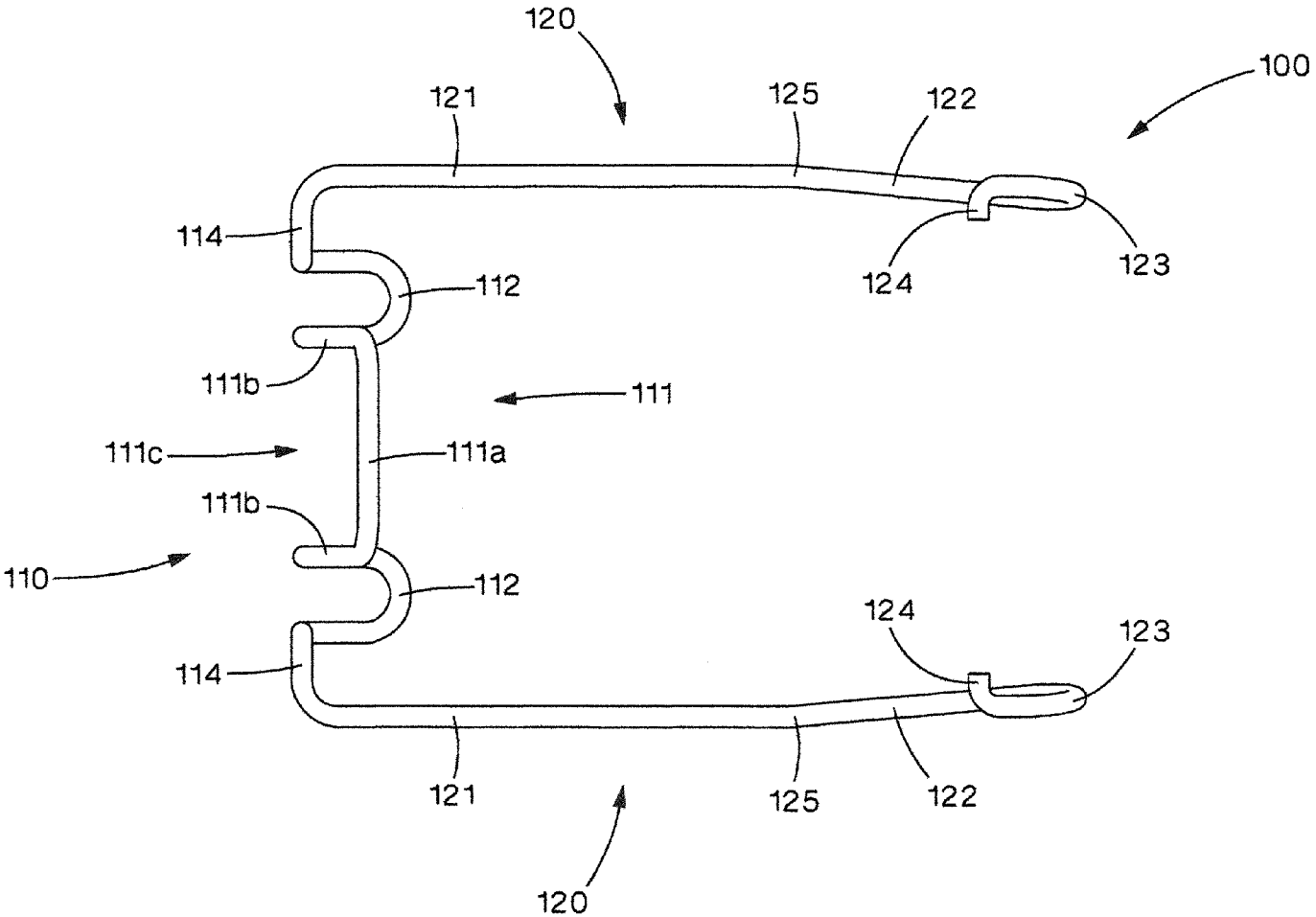
FIG. 2 is a top view of the wire power cord retainer of FIG. 1.
Figure 3:
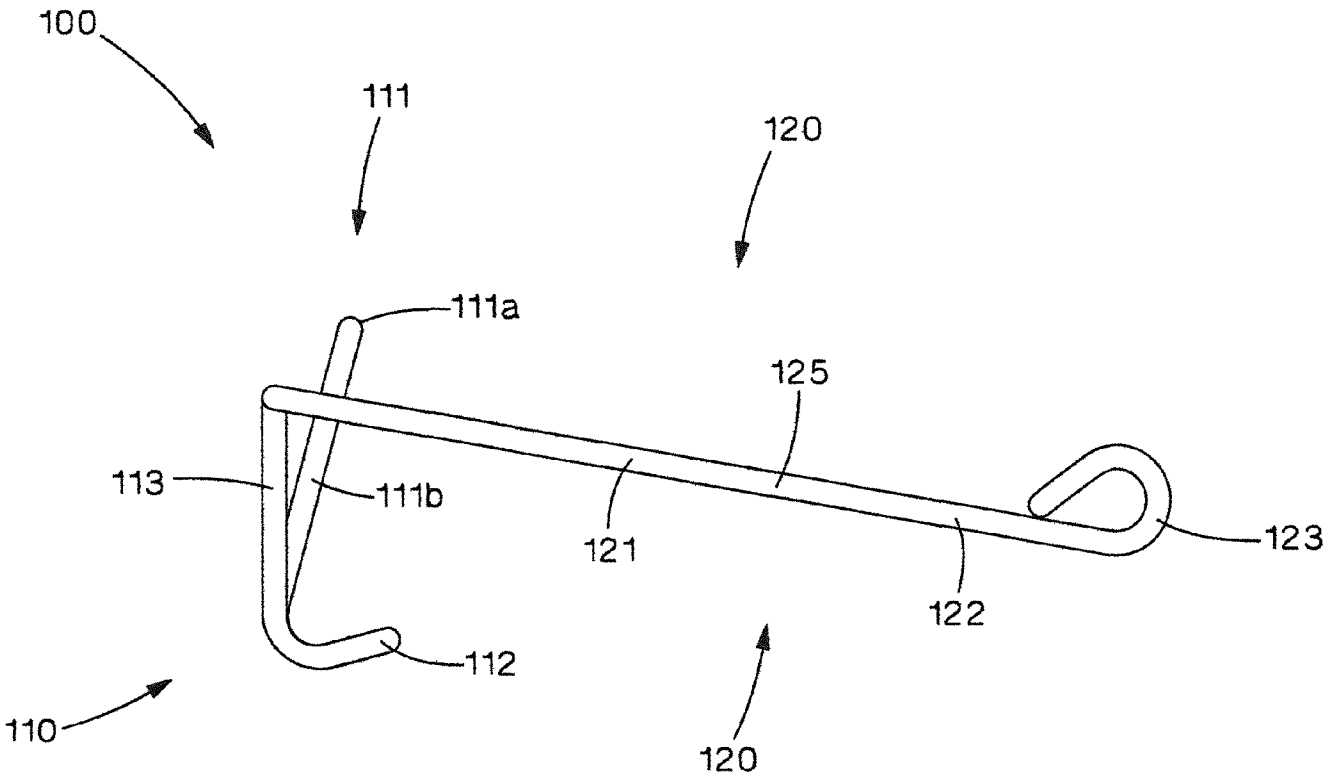
FIG. 3 is a side view of the wire power cord retainer of FIG. 1.
Figure 4:
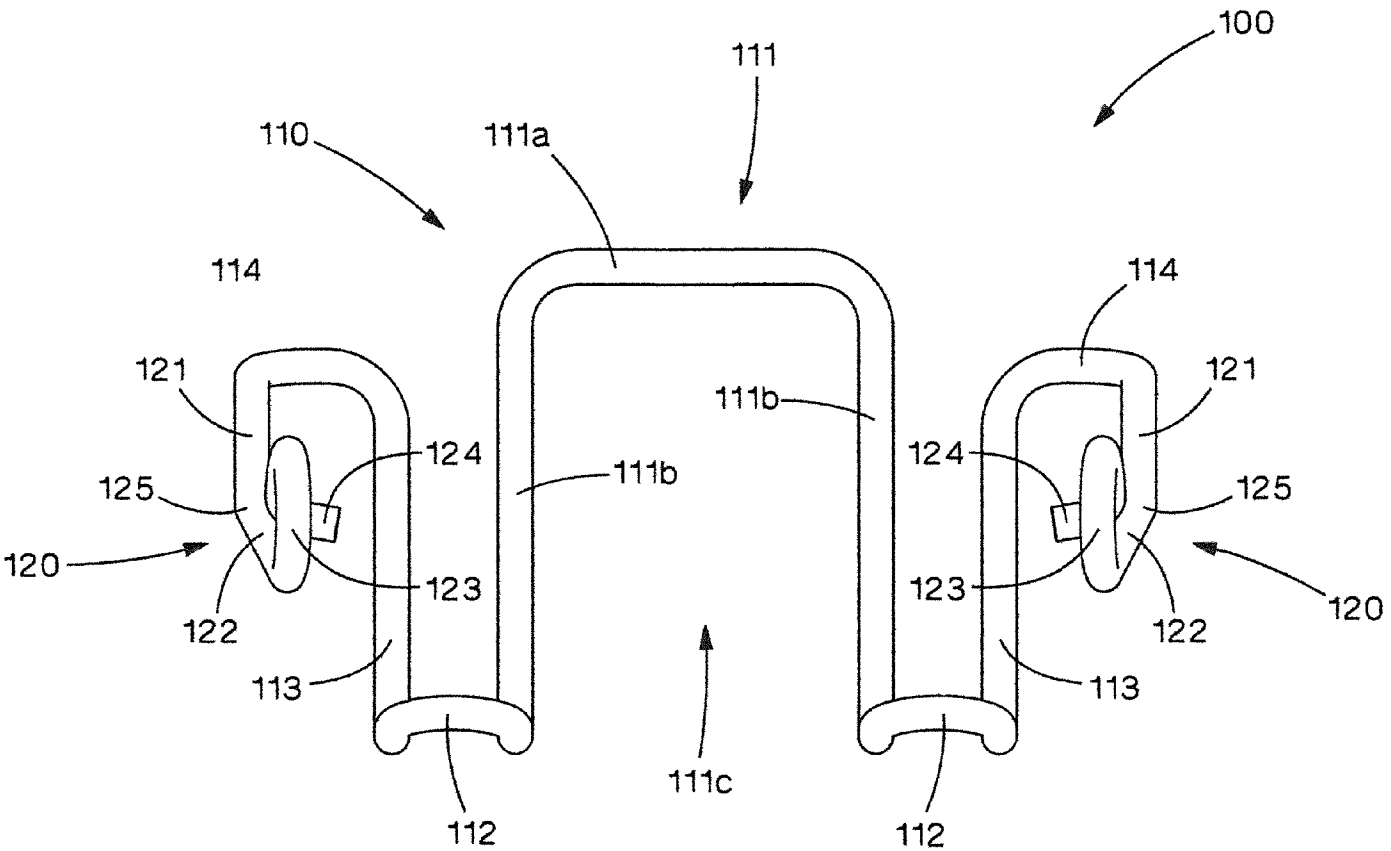
FIG. 4 is a back view of the wire power cord retainer of FIG. 1.
Figure 5:
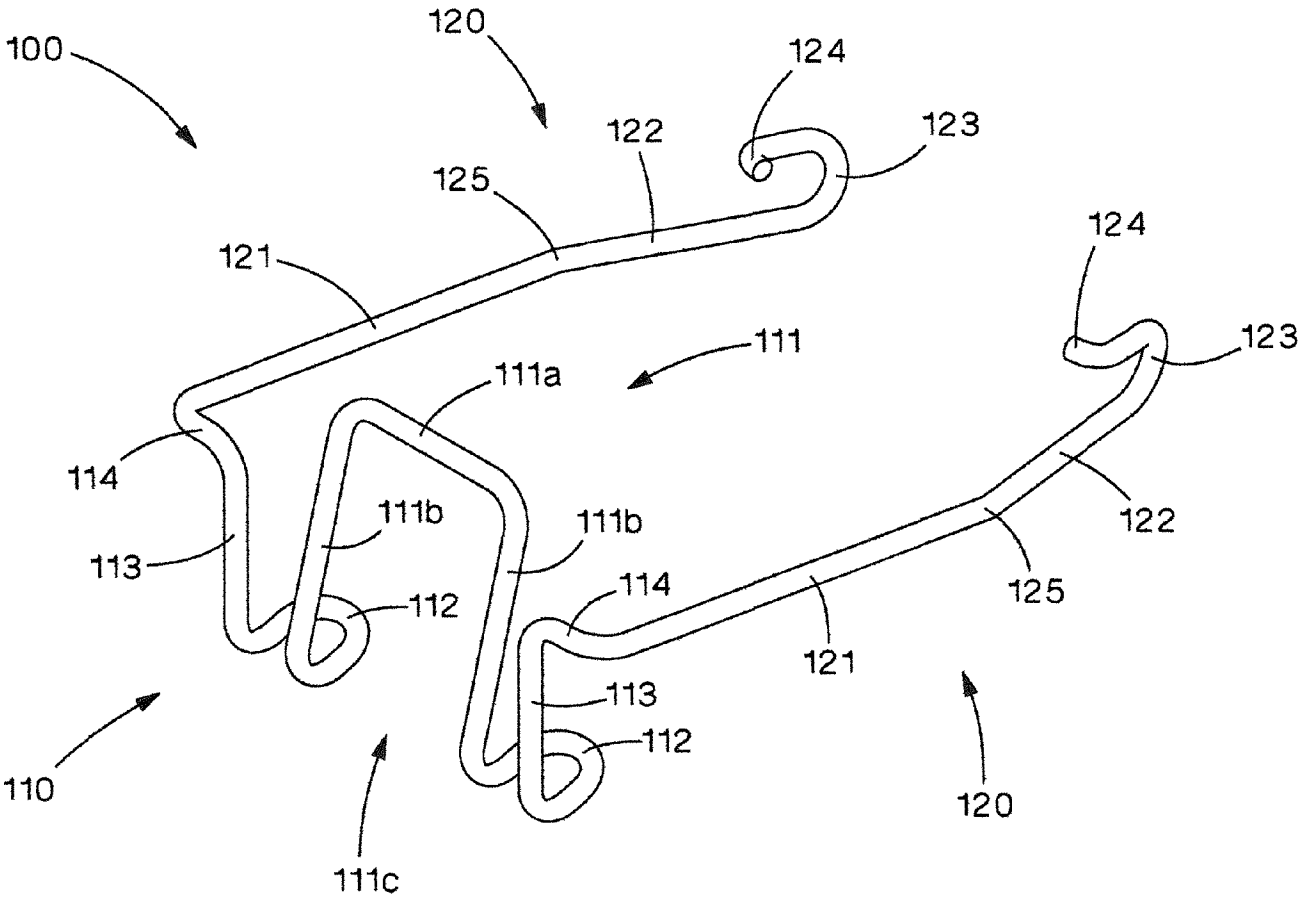
FIG. 5 is a perspective view of a wire power cord retainer according to an alternative embodiment of the present invention.
Figure 10:
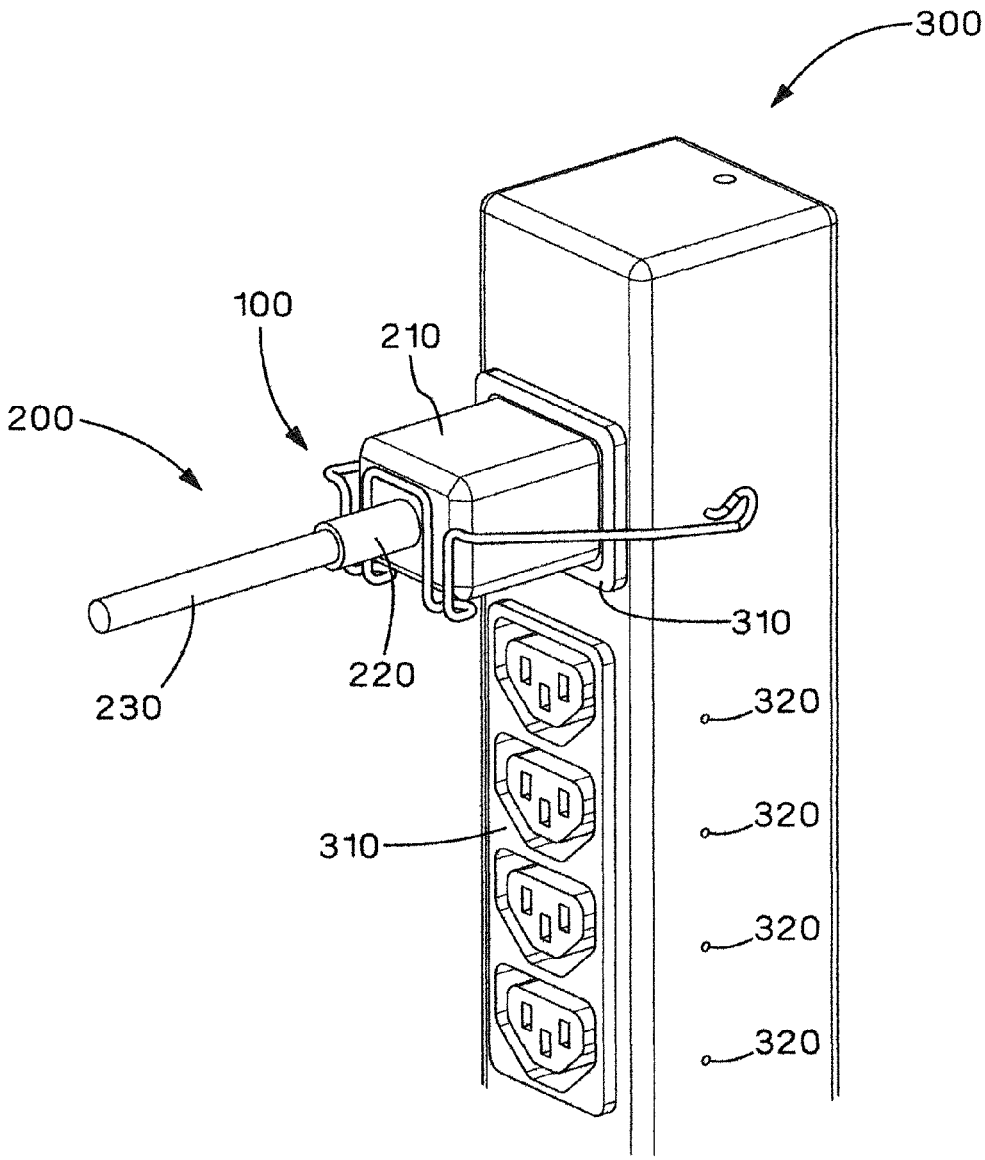
FIG. 10 is a perspective view of the wire power cord retainer of FIG. 9, showing the wire power cord retainer connected to the power cord.

As show in FIGS. 1-5, the wire power cord retainer 100 includes a body 110 and a pair of arms 120 extending from opposite sides of the body 110. The body 110 includes a retaining tab 111 and a pair of locking tabs 112 extending from opposite sides of the retaining tab 111. The retaining tab 111 includes a top segment 111*a* and a pair of side segments 111*b* extending from opposite sides of the top segment 111*a*. Together, the top segment 111*a* and the side segments 111*b* define an opening 111*c* for receiving the power cord 200 (FIG. 10). Each of the locking tabs 112 extends from one of the side segments 111*b* of the retaining tab 111. Additionally, the body 110 includes a plurality of body segments, such as a first body segment 113 extending upwardly from the adjacent locking tab 112 and a second body segment 114 extending outwardly from the first body segment 113. Each of the arms 120 includes a plurality of arm segments, such as a first arm segment 121 extending from the second body segment 114 and a second arm segment 122 extending from the first arm segment 121, as well as a safety loop 123 and an inwardly-facing end 124 extending inwardly from the safety loop 123. As shown in FIGS. 1-4, the safety loops 123 are closed, but it is likewise contemplated that the safety loops 123 are open (FIG. 5).

Figure 6:
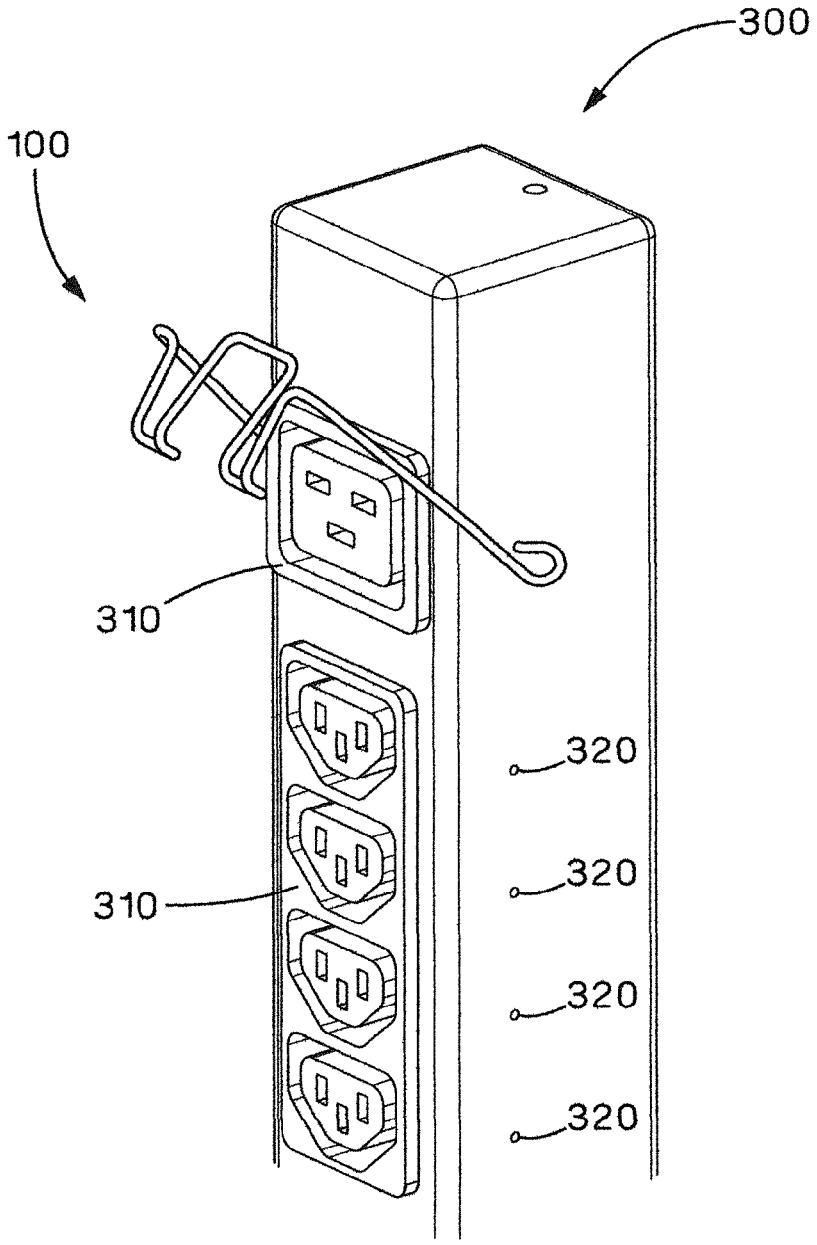
FIG. 6 is a perspective view of the wire power cord retainer of FIG. 1, showing the wire power cord retainer connected to a POU according to an embodiment of the present invention.
Figure 7:
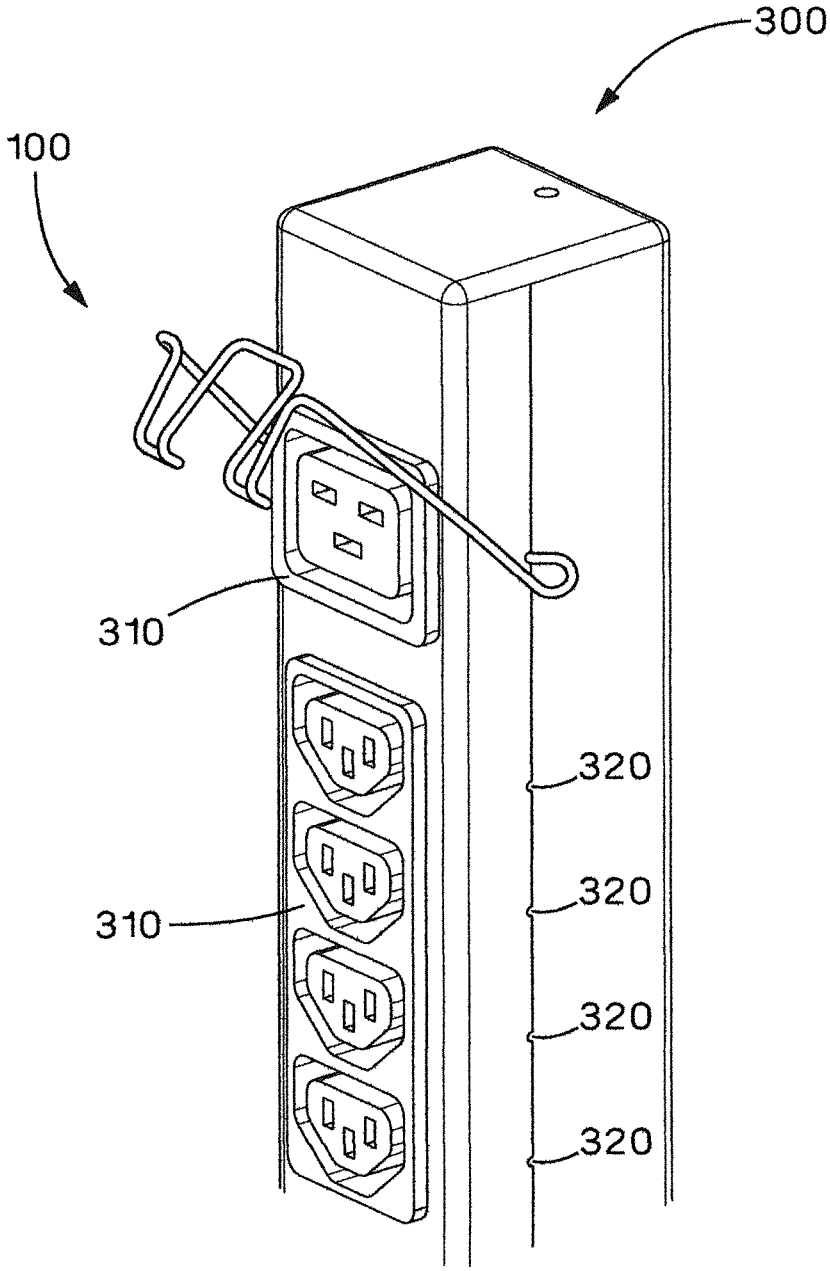
FIG. 7 is a perspective view of the wire power cord retainer of FIG. 1, showing the wire power cord retainer connected to a POU according to an alternative embodiment of the present invention.

As shown in FIGS. 6-12, the power cord 200 includes a plug 210, a strain relief 220, and a cord 230, and the POU 300 includes a plurality of power outlets 310, each of which is adapted to receive a plug, such as the plug 210 of the power cord 200 (FIG. 9), and a plurality of openings 320, such as holes (FIG. 6) or slots (FIG. 7), adjacent the power outlets 310, each of which is adapted to receive a power cord retainer, such as the wire power cord retainer 100 (FIGS. 6 and 7).

As shown in FIGS. 6 and 7, the wire power cord retainer 100 is connected to the POU 300. For example, each of the arms 120, or a portion thereof, such as the inwardly-facing end 124, is inserted into one of the openings 320 in the POU 300, rotatably connecting the wire power cord retainer 100 to the POU 300. Preferably, each of the arms 120, or at least a portion thereof, such as the second arm segment 122, is bent inwardly, for example, at bend point 125 (FIG. 2), further securing the wire power cord retainer 100 to the POU 300.

Figure 8:
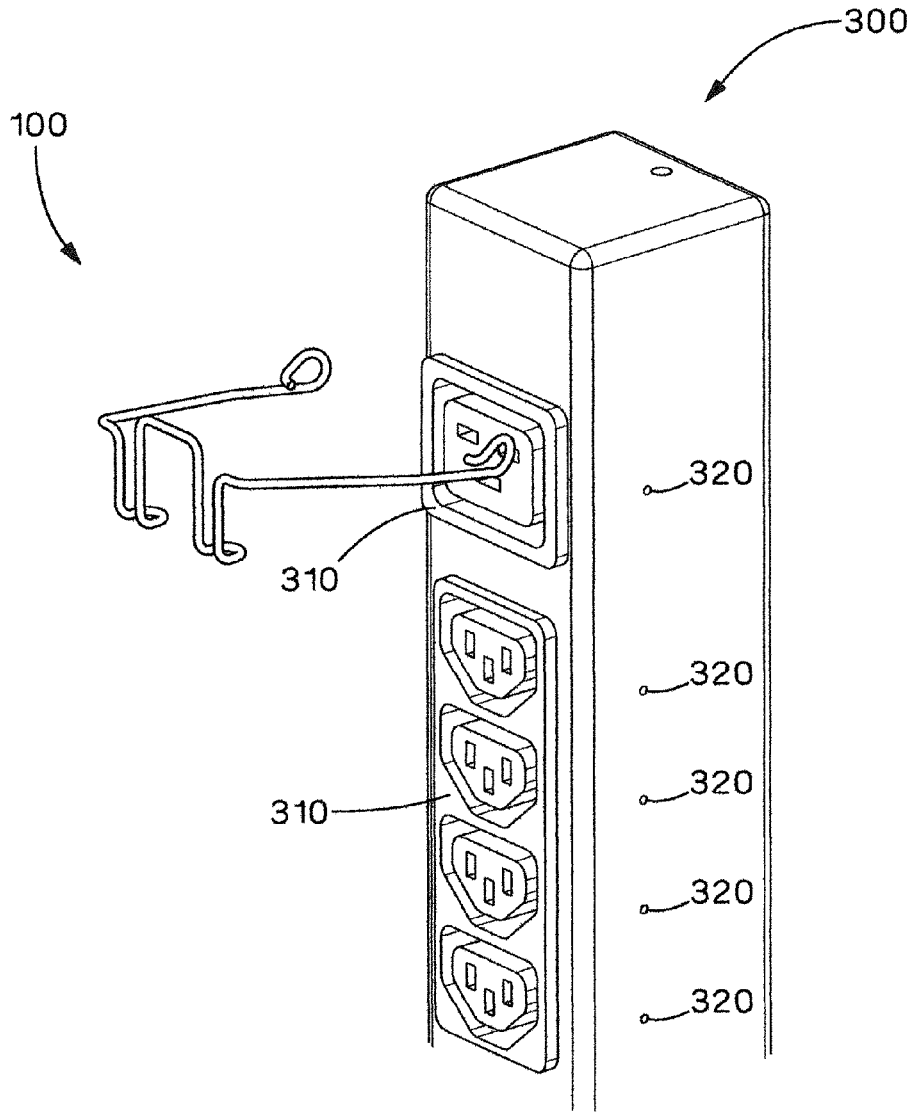
FIG. 8 is a perspective view of the wire power cord retainer of FIG. 6, showing the wire power cord retainer being inserted into a power outlet of the POU.

As shown in FIG. 8, the safety loops 123 prevent the wire power cord retainer 100, or at least a portion thereof, such as the inwardly-facing ends 124, from being inserted into the power outlet 310 of the POU 300, potentially causing an electric shock. For example, the safety loops 123 are configured so that the inwardly-facing ends 124 do not fit within the openings in the power outlets 310.

Figure 9:
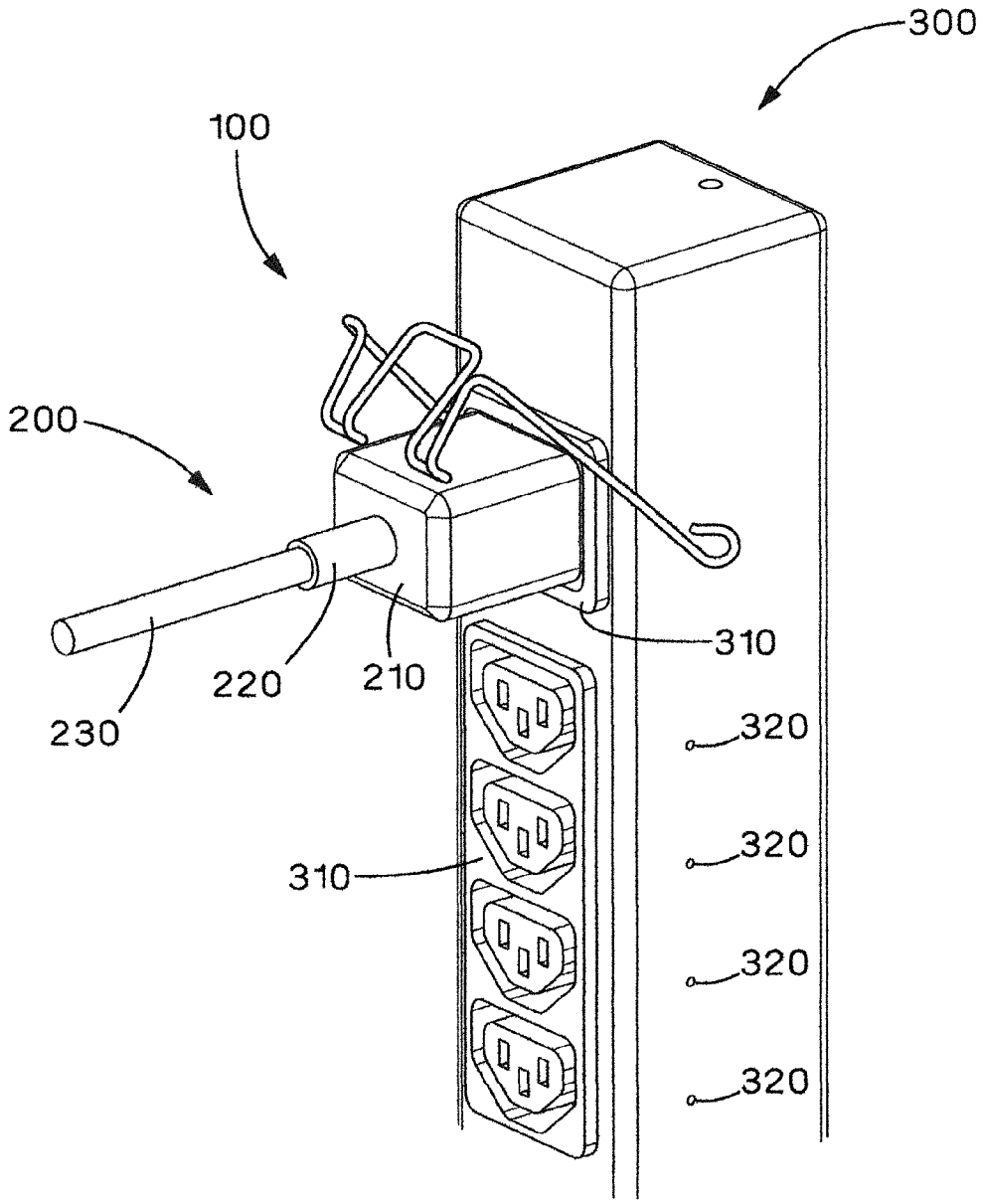
FIG. 9 is a perspective view of the wire power cord retainer of FIG. 6, showing the power cord connected to the POU.

As shown in FIG. 9, the power cord 200 is connected to the POU 300. For example, the plug 210 of the power cord 200 is inserted into one of the power outlets 310 of the POU 300, electrically connecting the power cord 200 to the POU 300.

Figure 11:
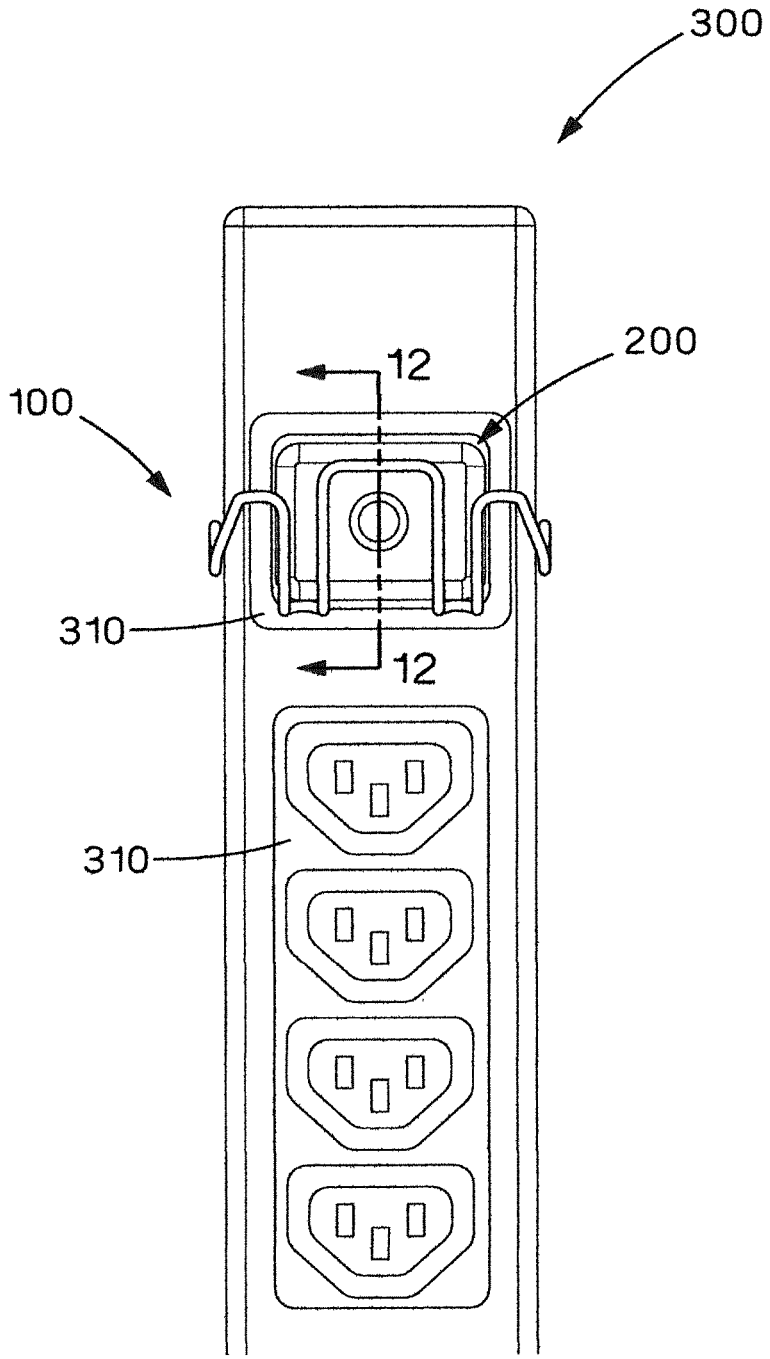
FIG. 11 is a front view of the wire power cord retainer of FIG. 10.
Figure 12:
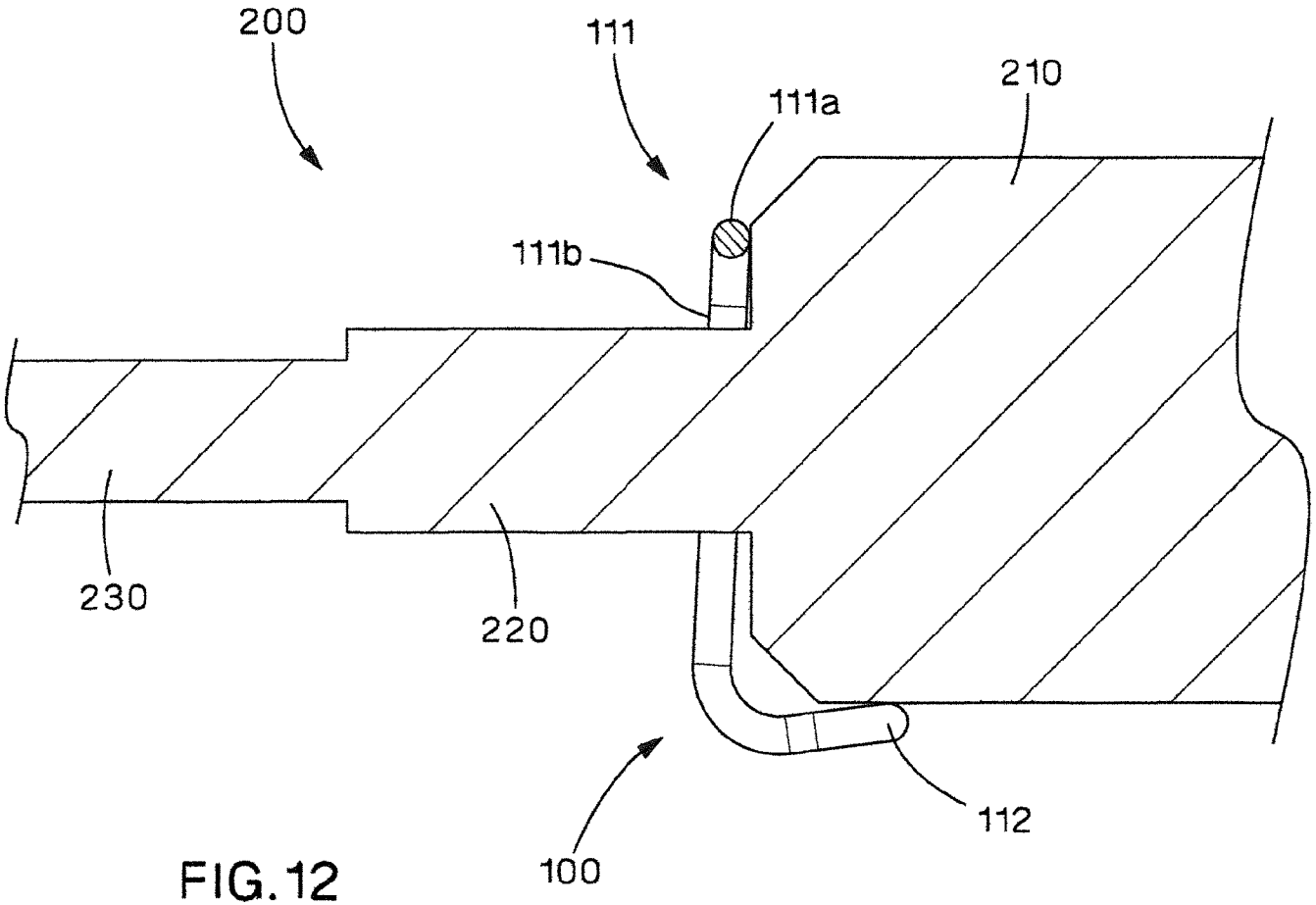
FIG. 12 is a cross-sectional view of the wire power cord retainer of FIG. 11 taken along line 12-12.

As shown in FIG. 10-12, the wire power cord retainer 100 is connected to the power cord 200. For example, the wire power cord retainer 100 is rotated over the power cord 200. The locking tabs 112 engage a bottom portion of the plug 210, securing the wire power cord retainer 100 to the power cord 200. The retaining tab 111 engages a back portion of the plug 210, securing the power cord 200 to the POU 300. Preferably, the retaining tab 111 and the locking tabs 112 are bent inwardly (FIG. 3), further securing the wire power cord retainer 100 to the power cord 200 and the power cord 200 to the POU 300.

While this invention has been described in conjunction with the exemplary embodiments outlined above, various alternatives, modifications, variations, and/or improvements, whether known or presently unforeseen, may become apparent. Accordingly, the exemplary embodiments of the invention as set forth above are intended to be illustrative, not limiting. Various changes may be made without departing from the spirit and scope of the invention.

The invention claimed is:

1. An apparatus for retaining a plug in an outlet, the apparatus comprising:

a body; and a pair of arms extending from opposite sides of the body, wherein the body includes a retaining tab for retaining the plug in the outlet and a pair of locking tabs extending from opposite sides of the retaining tab for locking the retaining tab to the plug, wherein the locking tabs are U-shaped.

2. The apparatus of claim 1, wherein the retaining tab is U-shaped.

3. The apparatus of claim 1, wherein the retaining tab defines an opening for receiving a power cord extending from the plug.

4. The apparatus of claim 1, wherein the retaining tab biases the plug toward the outlet.

5. The apparatus of claim 1, wherein the locking tabs bias the plug toward the retaining tab.

6. The apparatus of claim 1, wherein each of the arms includes a safety loop for preventing the arms from being electrically connected to the outlet.

7. The apparatus of claim 1, wherein each of the arms includes an inwardly-facing end for removably and rotatably connecting the arm to the outlet.

8. The apparatus of claim 6, wherein each of the arms includes a first arm segment and a second arm segment, the first arm segment extending from the body to a bend point and the second arm segment extending from the bend point to the safety loop, the bend point biasing the second arm segment toward the outlet.

9. An apparatus for retaining a plug in an outlet, the apparatus comprising:

a body; and a pair of arms extending from opposite sides of the body, wherein the body includes a retaining tab for retaining the plug in the outlet and a pair of locking tabs extending from opposite sides of the retaining tab for locking the retaining tab to the plug, wherein the locking tabs bias the plug toward the retaining tab.

10. The apparatus of claim 9, wherein the retaining tab is U-shaped.

11. The apparatus of claim 9, wherein the retaining tab defines an opening for receiving a power cord extending from the plug.

12. The apparatus of claim 9, wherein the retaining tab biases the plug toward the outlet.

13. The apparatus of claim 9, wherein each of the arms includes a safety loop for preventing the aims from being electrically connected to the outlet.

14. The apparatus of claim 9, wherein each of the arms includes an inwardly-facing end for removably and rotatably connecting the arm to the outlet.

15. The apparatus of claim 13, wherein each of the arms includes a first arm segment and a second arm segment, the first arm segment extending from the body to a bend point and the second arm segment extending from the bend point to the safety loop, the bend point biasing the second arm segment toward the outlet.

16. An apparatus for retaining a plug in an outlet, the apparatus comprising:

a body; and a pair of arms extending from opposite sides of the body, wherein the body includes a retaining tab for retaining the plug in the outlet and a pair of locking tabs extending from opposite sides of the retaining tab for locking the retaining tab to the plug, wherein each of the arms includes a safety loop for preventing the arms from being electrically connected to the outlet, and wherein each of the arms includes a first arm segment and a second arm segment, the first arm segment extending from the body to a bend point and the second arm segment extending from the bend point to the safety loop, the bend point biasing the second arm segment toward the outlet.

17. The apparatus of claim 16, wherein the retaining tab is U-shaped.

18. The apparatus of claim 16, wherein the retaining tab defines an opening for receiving a power cord extending from the plug.

19. The apparatus of claim 16, wherein the retaining tab biases the plug toward the outlet.

20. The apparatus of claim 16, wherein each of the arms includes an inwardly-facing end for removably and rotatably connecting the arm to the outlet.

* * * * *